United States Patent [19]

Bingaman

[11] 4,003,489

[45] Jan. 18, 1977

[54] VALVED CANNING LID

[76] Inventor: Harold J. Bingaman, 6309 Pentz-Magalia Highway, Paradise, Calif. 95969

[22] Filed: Oct. 24, 1975

[21] Appl. No.: 625,376

[52] U.S. Cl. ..... 215/260; 215/262; 215/270

[51] Int. Cl.[2] ..... B65D 51/16

[58] Field of Search ..... 215/260, 261, 262, 270, 215/271, 276, 307, 310

[56] References Cited

UNITED STATES PATENTS

| | | | |
|---|---|---|---|
| 1,576,763 | 3/1926 | Ingram | 215/260 |
| 1,808,702 | 6/1931 | Williams | 215/260 |
| 1,857,015 | 5/1932 | Gere | 215/260 |
| 1,915,523 | 6/1933 | Ferguson | 215/260 |
| 2,449,014 | 9/1948 | Shaffer | 215/260 |

*Primary Examiner*—Herbert F. Ross

[57] ABSTRACT

This invention relates to a canning jar sealer lid provided with a mechanically activated valve and a means for operating the valve manually.

In one embodiment, a sectional sealer lid designed for use with screw bands and other holders is constructed in two parts containing apertures and gaskets so arranged that when they are fitted together and held to a canning jar lip by a holder, they unite to form a sealer lid and a relief valve. In use on a jar, the valve formed by the sections of this lid working conjointly will activate according to internal jar pressure applied vacuum sealing the jar or releasing said pressure, and there is a means supplied to manually open the valve externally.

A modified embodiment is a single thickness canning jar sealer lid designed for use with screw bands and other holders which has a pressure relief means installed directly through the lid section. When this lid is affixed to a canning jar lip, the means will activate according to internal jar pressure to vacuum seal the jar or to release the pressure. This lid also has an external fixture provided for operating the valve manually.

2 Claims, 11 Drawing Figures

VALVED CANNING LID

Figure 1:
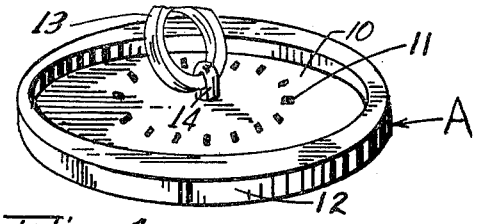
Figure 2:
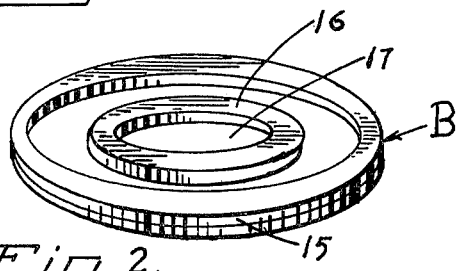
Figure 3:
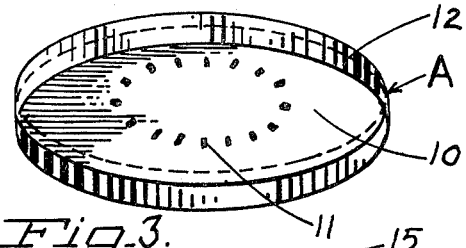
Figure 4:
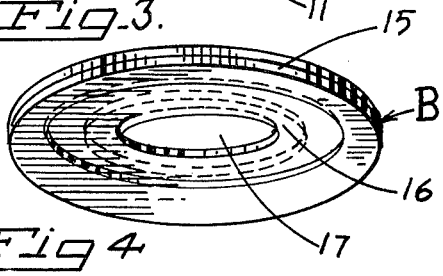
Figure 5:
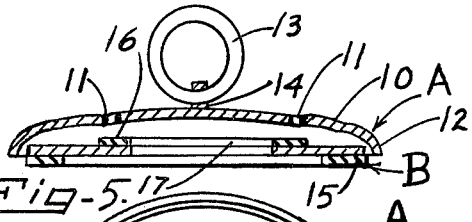
Figure 6:
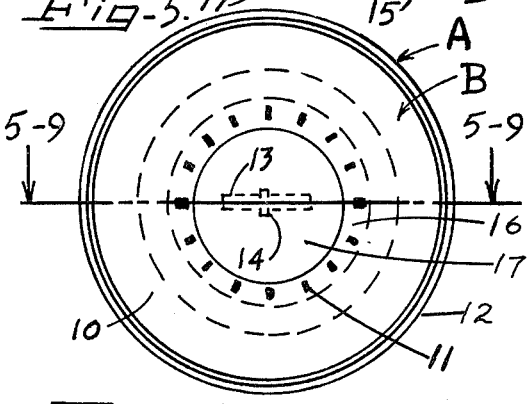
Figure 7:
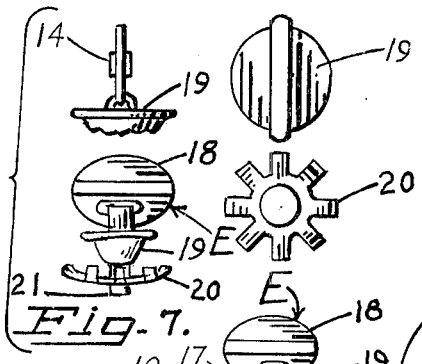
Figure 8:
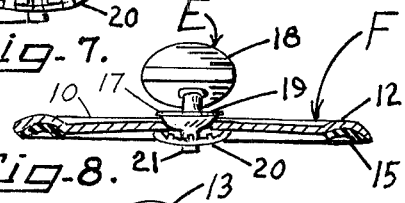
Figure 9:
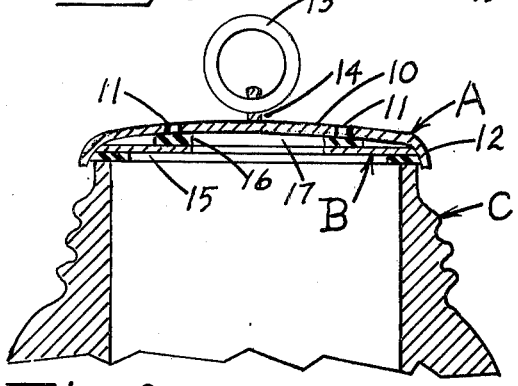
Figure 10:
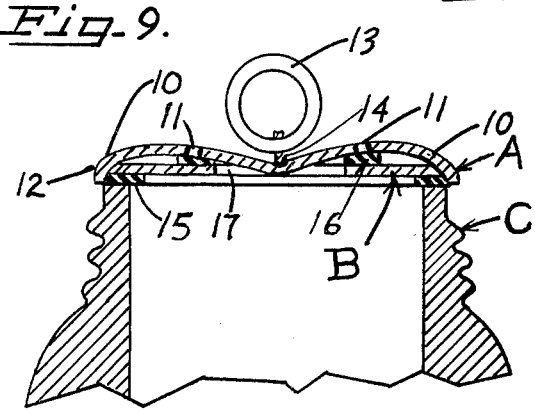
Figure 11:
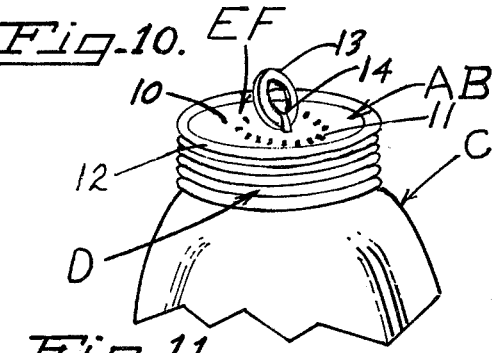

With no new art having made an impression in the market place, conventional sealer lids generally used by the home canner today are considered expendable. The most commonly used lid is worked up and down by cooking pressures escaping along the jar lip during the canning process. The sealer gasket on this type of lid is usually rendered lifeless after one application, and the usefulness of the lid is severely limited. The possibility also exists that some of the cooking materials will boil out under the sealer of the lifted lid. A later danger can then develop that a bacterial path having been formed, the food in the sealed jar could become contaminated. Also, these sealer lids usually require prying to remove them from the jar lip. Prying can be damaging to the lid making its safe use more than once doubtful. From a manufacturing standpoint, the design of conventionally used sealer lids considerably limits the choice of material applicable.

In the prior art, attempts to improve upon canning jar sealer lids do not appear to have challenged the superiority of the original single snap lids presently in demand by home canners. A patent issued to John J. Williams, U.S. Pat. No. 1,808,702, dated June 2, 1931, shows a relief valve and sectional lid approach. His cap with a single aperture in the top and a padded sealer disc has the disadvantage of small apertures facing down towards the processing food and the danger of the food entering these apertures. The double sealer rings as required in this lid are inconvenient, and the inventor provides no method to manually unseal his relief valve other than unscrewing the cap.

These small downward facing apertures are again present in the sealer lid described in U.S. Pat. No. 1,576,763, issued to H. Ingram on Mar. 16, 1926. No means is supplied for releasing vacuum to protect the cap from damage when twisting it off the jar.

The present invention is designed to overcome limitations in currently used sealer lids. As illustrated in the drawings and described in more detail hereinafter, the valved lid comprising this invention eliminates the need for sealer lid surface movement either to release internal jar pressure or to vacuum seal the lid to the jar lip. And as the thickness of the material used in the main sealer section is not critical, the possibilities for usable materials in the manufacture of the present invention is greatly enlarged.

Therefore, this invention is a canning jar sealer lid provided with a pressure relief valve in the surface of the lid. The valve is preset to operate as needed so the lid and sealer gasket at the lip of the jar are not required to lift for releasing internal jar pressure during the canning process.

A sectional embodiment of the present invention, the valved canning lid, is provided with an external sealer or cap and an internal sealer or disc hereinafter referred to as cap and disc. A sealer gasket extends around the circumference of the disc on the under surface of a size and arrangement to fit the lip of a conventional canning jar. The cap fits snuggly over the disc sealing off an aperture in the center of the disc. On the upper surface of the disc and around the aperture, there is a rubberized gasket. Directly above the rubberized gasket, there is a ring of slits in the cap. When the cap and the disc are fitted together, the gasket around the aperture in the disc seals off the slits in the cap.

Acting conjointly, the slits in the cap and the gasketed aperture in the disc operate as a relief valve. Pressure from within a jar pushing against the under surface of the cap through the aperture in the disc can force the cap slits away from the disc gasket and release the internal jar pressure. When a jar is vacuum sealed, the center section of the cap is sucked down tightly against the disc aperture gasket shutting off the cap slits completely. An external means is supplied for opening the slits manually to unseal a vacuum sealed sectional lid. The two sections of this lid are also held together by vacuum. A slight protrusion of the circumference disc gasket contacts the inner surface of the cap retainer band or rim. This contact causes a seal which creates some vacuum between the interfaced surfaces of the cap and disc, holding the two sections firmly together. For cleaning, they can be separated by lightly pressing on the cap or by warming.

In a single surface embodiment of this invention, a pressure relief valve seats in an aperture centered in and completely through the sealer lid surface. The valve operates independently of sealer lid movement eliminating frictional wear on both the sealer lid and the sealer gasket. The valve acts as both a relief valve and a vacuum sealer. A means for opening the valve to release a vacuum sealed lid is provided making the lid easy to remove without the necessity of prying. Spring tension applied to the lower shaft of the valve by a especially designed star spring holds the valve shut so the lid can be used as a cap for an opened jar as needed.

Both embodiments of this invention, the sectional lid and the single-thickness lid, are designed to be used either as sealer lids only held in place by separate screw bands or other holders or as complete caps with screw bands or other holders permanently affixed.

I claim:

1. A canning jar sealer lid incorporating a mechanical relief valve and a means for operating the relief valve manually when said lid is secured to a jar with a conventional screw band, comprising: a sectional lid circular in shape, the lid having two sections including a flexible external sealer cap and a rigid internal sealer disc, the cap having a pull ring affixed by a pivot hinge and centered in the upper surface of the cap, this center pull ring surrounded by a circle of small openings cut through the cap material with the outer edge of the cap flanged downward to form a retaining rim containing an area slightly larger than the total circumference of the disc, the disc having a single aperture through the center with a gasket adhered around the aperture on the upper surface of the disc and a gasket adhered on the lower surface of the disc adjacent the outer circumference of the disc, the upper gasket around the disc aperture being in the same circular position as the holes through the cap, the two sections designed to cojoin into a single sealer lid.

2. A canning jar sealer lid incorporating a mechanical relief valve and a means for operating the relief valve manually when said lid is secured to a jar with a conventional screw band, said sealer lid comprising a rigid disc of single thickness and having an aperture centrally thereof, said disc having a beveled snap rim and sealer gasket retained within the bevel of said rim, valve means fitted within the aperture of said disc, said valve means being movable independent of said disc and having a capped conical shape wider at the top than the aperture opening and narrower at the bottom to fit through said aperture, a slightly concaved star shaped spring of flexible material having a centrally located hole for receiving said valve, the concave side of said spring biasing against the underside of said disc, and a hinged pull tab affixed to the top of said valve for manual movement of said valve away from the top of said disc and against the biasing of said spring thereby opening said aperture.

* * * * *